United States Patent [19]

McCormick

[11] Patent Number: 4,673,074

[45] Date of Patent: Jun. 16, 1987

[54] MULTI-COIN OPERATED DISPENSING MECHANISM

[75] Inventor: Gary D. McCormick, Skokie, Ill.

[73] Assignee: National Sanitary Laboratories, Inc., Lincolnwood, Ill.

[21] Appl. No.: 664,756

[22] Filed: Oct. 25, 1984

[51] Int. Cl.[4] ..... G07F 5/06

[52] U.S. Cl. ..... 194/236; 194/255

[58] Field of Search ..... 194/1 G, DIG. 2, 61–66, 194/1 Q, 1 J, 236, 255

[56] References Cited

U.S. PATENT DOCUMENTS

| | | | |
|---|---|---|---|
| 1,862,372 | 6/1932 | Richardson | 194/DIG. 2 |
| 1,874,497 | 8/1932 | Gildemeister | 194/DIG. 2 |
| 3,010,557 | 11/1961 | Weitzman | 194/63 |
| 3,376,966 | 4/1968 | Pennell | 194/63 |
| 3,887,054 | 6/1975 | Allen | 194/92 |
| 3,970,181 | 7/1976 | Rubio | 194/63 |
| 4,034,840 | 7/1977 | Reitman | 194/65 |
| 4,055,243 | 10/1977 | Brand | 194/236 |
| 4,350,239 | 9/1982 | Tsuiki | 194/1 G |

*Primary Examiner*—Joseph J. Rolla
*Assistant Examiner*—Gregory L. Huson

[57] ABSTRACT

Disclose is a coin-operated dispensing mechanism, a basic element of which is a disc-like, coin-receiving wheel having at least a first perimetrical coin-receiving receptacle, the thickness of which is substantially equal to a plural multiple of the thickness of a coin of predetermined denomination. The first receptacle is dimensioned for receiving a number of coins in face-to-face relationship, the number being equal to the plural multiple. It is disclosed that the thickness of the wheel equals the thickness of the receptacle, so that the receptacle extends from one face of the wheel to the other. The mechanism also includes a system of pawls or dogs which prevent undesired rotation of the wheel, including a coin dog or pawl and an independently-functioning auxiliary coin dog or pawl which prevents dispensing rotation of the wheel if only one coin instead of two is placed in the coin-receiving receptacle.

4 Claims, 9 Drawing Figures

MULTI-COIN OPERATED DISPENSING MECHANISM

BACKGROUND OF THE INVENTION

This invention relates to a coin-operated dispensing mechanism, typically used in vending machines, and is an improvement over that of U.S. Pat. No. 3,970,181, assigned to the assignee hereof.

The '181 patent discloses a coin-operated mechanism which dispenses merchandise upon insertion of two coins of predetermined denomination and certain manipulation by the customer. More particularly, the mechanism of the '181 patent includes a coinreceiving wheel having diametrically opposed coin receptacles. The coin-receiving wheel must be rotated a full 360 degrees (one-half revolution for each coin) to effect a dispensing operation. The mechanism of the Rubio patent is rather complex, including, among other parts, an actuator plate and a clutch provided by a cam flange, a drive plate and a drive pawl. These parts are rather expensive to manufacture and additionally contribute to assembly cost.

As stated in the '181 patent, the mechanism thereof was developed in response to price inflation and consequent rapid price increase of merchandise sold from vending machines, and provides a mechanism which dispenses upon insertion therein of two coins (e.g., quarters), and which can easily be substituted for a mechanism which dispenses upon insertion therein of a single quarter.

Inflation persists and prices are still rising. Thus, items which have sold for fity cents may now sell for seventy-five cents or a dollar. Or a lower-priced item may be inserted instead of a higher-priced one. Hence, it is desirable to have a coindispensing mechanism which enables the vend amount for the item to be changed. More particularly, it is desirable to have a mechanism which dispenses upon insertion therein of combinations of more than two coins of predetermined denomination, say four quarters.

The present invention addresses and solves the problem of providing a coinoperated dispensing mechanism which may be converted to dispense upon insertion therein of selectable combinations of more than two coins of predetermined denomination. Also, the present invention may be utilized to effect dispensing upon insertion therein of two or more coins, but with only a 180 degree rotation of the coin-receiving wheel instead of 360 degrees.

At the same time, the invention presents a mechanism which, with respect to that of the '181 patent, is simpler to operate, quicker to operate, simpler in construction, eliminating the actuator plate and clutch, cheaper to manufacture, surer in operation, more conducive to sales and customer satisfaction, and cheaper to maintain, and requires no electricity or electrical connection to function.

Additionally, the mechanism of the present invention is more versatile than that of the '181 patent in terms of adaptability of coin combinations required for dispensing.

Important objects of the invention are to provide an improved coin-operated dispensing mechanism attaining the foregoing advantages.

SUMMARY OF THE INVENTION

A basic element of the coin-operated mechanism of the present invention is a disc-like coin-receiving wheel having at least a first perimetrical coin-receiving receptacle, the thickness of which is substantially equal to a plural multiple of the thickness of a coin of predetermined denomination. The first receptacle is dimensioned for receiving a number of coins of the predetermined denomination in a face-to-face relationship, the number being equal to the plural multiple. As disclosed herein, the thickness of the wheel equals the thickness of the receptacle, so that the receptacle extends from one face of the wheel to the other.

Still more particularly, as disclosed herein, the plural multiple is 2, so that the first receptacle accommodates two such coins.

The disclosed wheel also includes: a second perimetrical coin-receiving receptacle the same as, and diametrically spaced from, the first receptacle; a third perimetrical coin-receiving receptacle in close circumferential proximity to the first receptacle and dimensioned to receive one or more coins of a predetermined denomination and a fourth perimetrical coin-receiving receptacle in close circumferential proximity to the second receptacle and diametrically spaced from the third receptacle. The fourth receptacle is the same as the third receptacle.

The thickness of the third and fourth receptacle is substantially equal to a multiple of the thickness of the coin of predetermined denomination, that multiple being 1 or 2.

Specifically, and as disclosed, the thickness of the third and fourth receptacles is the same as that of the first and second receptacles, so that each receptacle accommodates two such coins.

The mechanism of the invention also includes a system of pawls or dogs for preventing a dispensing operation, except when coins are properly placed in the wheel receptacles, while allowing a dispensing operationwwhen coins are properly in the receptacles. Included in the system are a coin dog or pawl and an independently-functioning auxiliary coin dog or pawl which prevents dispensing rotation of the wheel if only one coin instead of two is placed in a wheel receptacle.

The above and other objects of the invention will appear as the description of the invention proceeds.

DESCRIPTION OF THE DRAWING

The preferred embodiment of the invention is described below with reference to the accompanying drawing herein.

DESCRIPTION OF THE INVENTION

Figure 1:
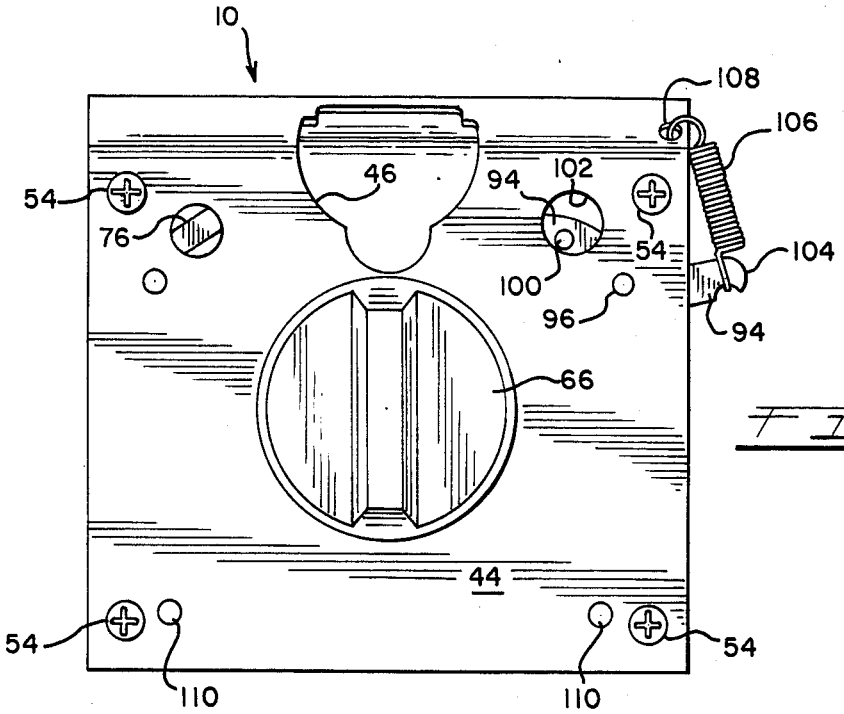
FIG. 1 is a front elevation of the preferred coin-operated mechanism according to the invention, including, among other parts not visible in FIG. 1, a rear plate and a coin-receiving wheel.
Figure 2:
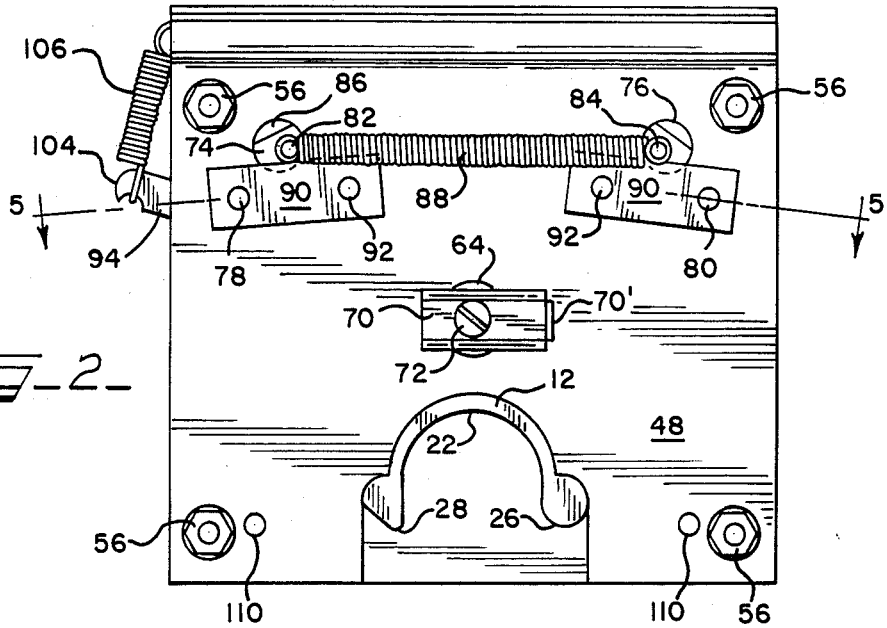
FIG. 2 is a rear elevation of the mechanism of FIG. 1, showing the rear plate.
Figure 5:
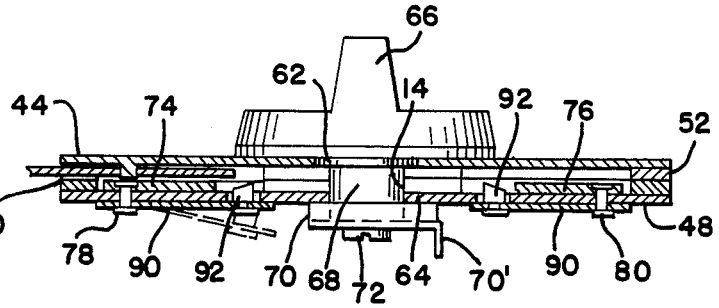
FIG. 5 is a view substantially on line 5—5 of FIG. 2.
Figure 6:
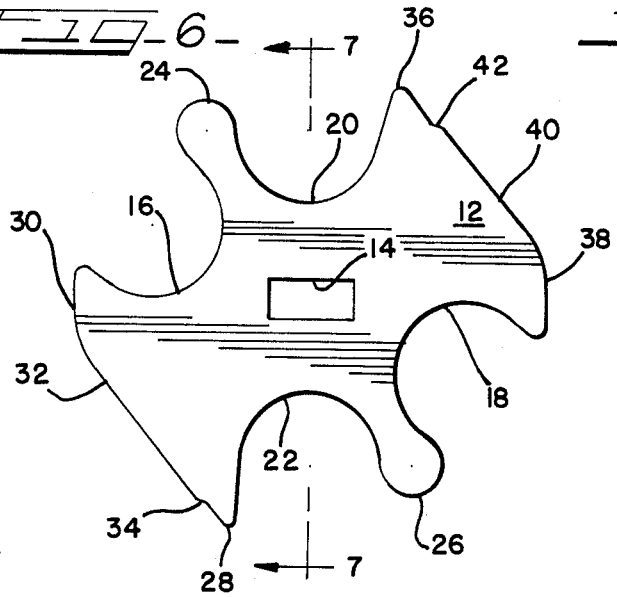
FIG. 6 is an elevation of the coin-receiving wheel.
Figure 7:
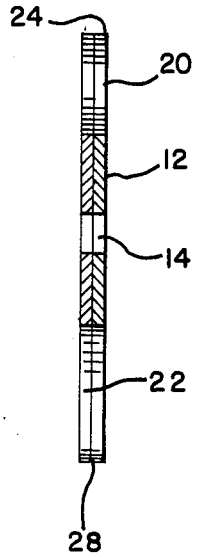
FIG. 7 is a view along line 7—7 of FIG. 6.

The drawing shows the coin-operated dispensing mechanism indicated generally at 10 in FIGS. 1, 2 and 5. Mechanism 10 includes, as a basic element, a disc-like coin-receiving wheel 12, best shown in FIGS. 3, 5, 6 and 7. Wheel 12 has a central non-circular hole 14 therethrough. As shown, hole 14 is rectangular.

Wheel 12 also has first, second, third and fourth perimetrical coin-receiving receptacles 16, 18, 20 and 22, respectively, each having a thickness substantially equal to a plural multiple of the thickness of a coin of predetermined denomination; receptacles 16, 18, 20 and 22 being dimensioned for receiving a number of coins of the predetermined denomination in face-to-face relationship, that number being equal to the plural multiple. Further, as shown, the thickness of wheel 12 is equal to the thickness of receptacles 16, 18, 20 and 22, whereby receptacles 16, 18, 20 and 22 extend from one face of wheel 12 to the other.

In the illustrated embodiment, the plural multiple referred to above is 2, whereby each of receptacles 16, 18, 20 and 22 can accommodate two coins of the predetermined denomination.

As shown, second receptacle 18 is the same as the diametrically spaced from first receptacle 16. Third receptacle 20 is in close circumferential proximity to first receptacle 16 and fourth receptacle 22 is in close circumferential proximity to second receptacle 18 and diametrically spaced from and the same as third recepatcle 20.

Still more particularly, wheel 12 includes a first lobed portion 24 circumferentially between first and third receptacles 16 and 20 and a second lobed portion 26 circumferentially between second and fourth receptacles 18 and 22. Further, wheel 12 has a third lobed portion 28 adjacent to fourth receptacle 22, a first convex arcuate portion 30 adjacent to first receptacle 16, a first substantially planar portion 32 between first arcuate portion 30 and third lobed portion 28 and a first shallow concave portion 34 between first planar 32 and third lobed portion 28. Also, wheel 12 includes a fourth lobe portion 36 adjacent to third receptacle 20, a second convex arcuate portion 38 adjacent to second receptacle 18, a second substantially planar portion 40 between second arcuate portion 38 and fourth lobed portion 36 and a second shallow concave portion 42 between second planar portion 40 and fourth lobed portion 36. First and second lobed portions 24 and 26 are alike and diametrically opposite, third and fourth lobed portions 28 and 36 are alike and diametrically opposite, first and second arcuate portions 30 and 38 are alike and diametrically opposite, first and second planar portions 32 and 40 are alike and diametrically opposite and substantially parallel and first and second concave portions 34 and 42 are alike and diametrically opposite.

Mechanism 10 further includes a front cover plate 44 having a coin-receiving slot 46, a rear plate 48, first and second spacer strips 50 and 52, respectively, clamped between cover plate 44 and rear plate 48 by screws 54 and nuts 56. Strips 50 and 52 have spaced apart generally arcuate inner edges 58 and 60, respectively, defining arcs of a common circle. The thickness of spacer strips 50 and 52 is slightly greater than that of wheel 12, which is between cover plae 44 and rear plate 48 and between spacer strips 50 and 52. Cover plate 44 and rear plate 48 have aligned central apertures 62 and 64 therethrough, respectively, as best seen in FIG. 5.

Mechanism 10 also includes an operating knob 66 protruding from cover plate 44 and having a non-circular shaft 68 extending through aperture 62 of cover plate 44, central hole 14 through wheel 12 and aperture 64 through rear plate 48. An actuator member 70 is secured to the end of shaft 68 remote from knob 66 by a screw 72 which engages a tapped hole in the end of shaft 68. Actuator member 70 has a finger 70' for engaing and moving a dispensing member, such as a bail (not shown) to perform a dispensing function. By virtue of engagement of non-circular shaft 68 in non-circular hole 14 of wheel 12, wheel 12 rotates with knob 66. Actuator member 70 also rotates with knob 66.

Disposed between cover plate 44 and rear plate 48 in complementary recesses in spacer strips 50 and 52, respectively, are a coin dog or pawl 74 and an antibackup dog or pawl 76. Pawls 74 and 76 are respectively mounted adjacent to the lower ends thereof on pivot pins 78 and 80 secured to rear plate 48. Carried by pawls 74 and 76 adjacent to the other ends thereof are lugs 82 and 84, respectively, which extend through openings 86 through rear plate 48 and are interconnected by a tension spring 88 which urges pawls 74 and 76 toward each other and toward the peripheral edge of wheel 12. Two spring steel bands 90 are disposed rearwardly of rear plate 48 below openings 86 and are fixedly secured, one to pin 78 and the other to pin 80. Washer dogs 92 are carried by bands 90 and extending through openings in rear plate 48. Dogs 92 are urged by bands 90 toward the rear face of wheel 12 along an imaginary circular line which passes approximately through the radial centers of receptacles 16, 18, 20 and 22.

Pawls 74 and 76 and the mounting thereof, bands 90, dogs 92 and the mounting thereof are all well-known in the art, being disclosed in the '181 patent.

Figure 3:
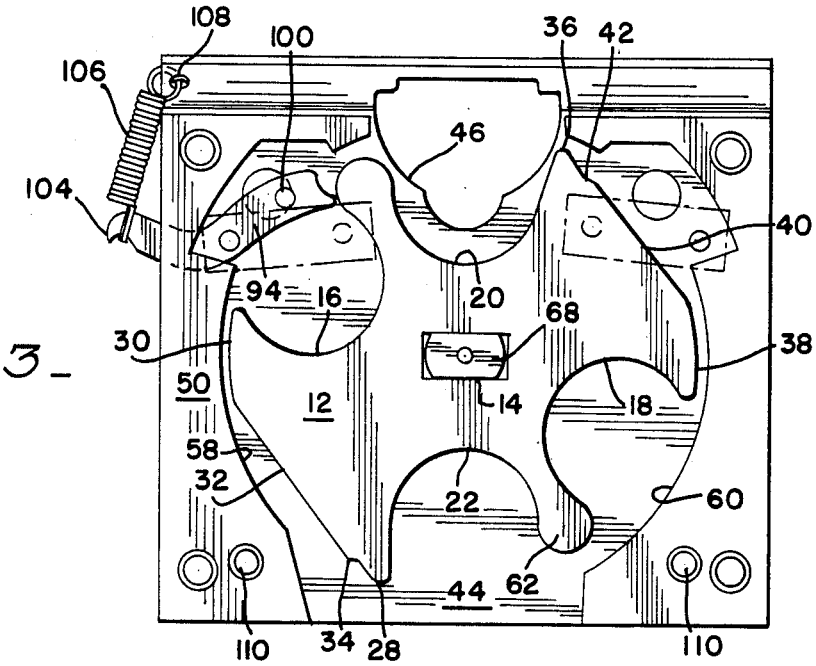
FIG. 3 is a view similar to FIG. 2, but with the rear plate removed.
Figure 4:
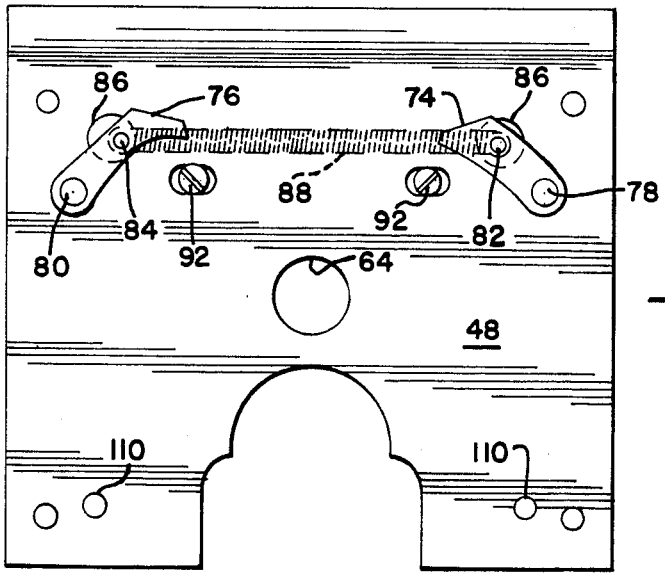
FIG. 4 is an elevation of the rear plate showing the opposite side thereof from that shown in FIG. 2.

It is noted that coin pawl 74 is located near the upper right-hand corner of rear plate 48 as seen from the front thereof in FIG. 4. An auxiliary coin dog or pawl 94 is mounted on a pivot pin 96 through cover plate 44, pin 96 being substantially aligned with pivot pin 78 on which pawl 74 is mounted. Pawl 96 extends inwardly from pivot pin 96 to an inner end 98 (FIG. 3). Between pivot pin 96 and inner end 98, pawl 94 carries a lug 100 which extends through an opening 102 through cover plate 44. Pawl 94 also extends outwardly from pivot pin 96 through a recess in spacer strip 50 and past the periphery of cover plate 44 to an outer end 104. One end of a tension spring 106 is affixed to outer end 104 and the other end of spring 106 is secured to a hole 108 through cover plate 44. Spring 106 pulls end 104 of pawl 94 upwardly, thus urging inner end 98 downwardly to a position limited by engagement of lug 100 with the wall of opening 102. In the so limited position, inner end 98 will engage wheel 12 in certain positions thereof.

Mechanism 10 is mounted on the front of a vending machine (not shown) by screws passing through mounting holes 110 through mechanism 10. The operation of mechanism 10 will now be described. With wheel 12 rotationally positioned with receptacle 16 facing vertically upward in registry with coin-receiving slot 46, two coins of proper denomination are placed in receptacle 16 and knob 66 is rotated clockwise in the direction of the arrow FIG. 1 until receptacle 20 is in registry with slot 46. Two additional coins of a preselected denomination are then placed in receptacle 20 and clockwise rotation of knob 46 is resumed until all four coins have dropped from their respective receptacles through the bottom of mechanism 10 into a coin box (not shown). Upon this event, finger 70' of actuator member 70 moves the dispensing member such that a dispensing function is performed. At this point, wheel 12 will be positioned with receptacle 20 facing vertically downward. To prepare wheel 12 for the next dispensing cycle, it is necessary to rotate knob 46 counterclockwise (against the direction of the arrow in FIG. 1) to rotate wheel 12 clockwise (in the direction of the arrow in FIG. 3) until receptacle 18 faces vertically upward in registry with slot 46, ready to receive two coins of the predetermined denomination in receptacle 18 and then two more in receptacle 22.

Antibackup pawl 76 and lobed portions 24, 26, 28 and 36 are so positioned and shaped that when wheel 12 is rotated in the direction opposite the direction of the arrow in FIG. 3, lobed portions 28 and 36 will pass pawl 76, but, whether or not coins are in receptacle 20 and 22, lobed portion 24 or 26, as the case may be, will engage pawl 76 to prevent further rotation in that direction. Without proper coins in recepatcle 16 or receptacle 18, when wheel 12 is rotated in the direction of the arrow in FIG. 3, lobed portion 24 or lobed portion 26, as the case may be, will engage coin pawl 74 and auxiliary coin pawl 94, thus to prevent further rotation in that direction. If receptacle 16 or receptacle 18, with coins properly therein, has passed pawls 74 and 94, and the proper coins are not in receptacle 20 or receptacle 22, completion of the dispensing operation will be prevented by engagement of lobed portion 36 or lobed portion 28 with pawls 74 and 94. With coins properly in the receptacles, the coins lift pawls 74 and 94 so that lobed portions 24, 26, 28 and 36 do not engage pawls 74 and 94, thus allowing completion of the dispensing operation.

As is taught in the '181 patent, washer dogs 92 prevent operation of mechanism 10 by washers instead of coins by moving to engage the centrally-positioned hole commonly found in such washers.

Auxiliary pawl 94, which acts independently of pawl 74, functions to prevent dispensing rotation of wheel 12 if only one coin instead of two is placed in a wheel receptacle.

Figure 8:
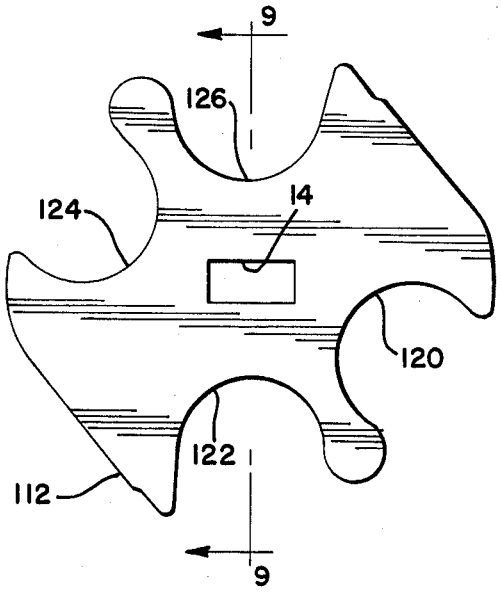
FIG. 8 is an elevation of another embodiment of the coin-receiving wheel.
Figure 9:
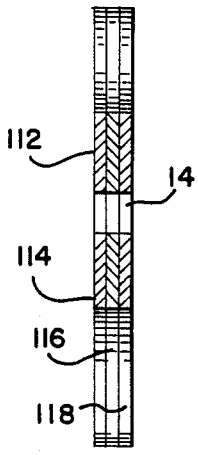
FIG. 9 is a view along line 9—9 of FIG. 8.

FIGS. 8 and 9 illustrate yet another embodiment of the present invention wherein three individual disks are stacked, or "ganged," to produce a coin-receiving wheel 112 made up of individual disks 114, 116, and 118. Coin-receiving receptacles 120, 122, 124 and 126, as seen in FIG. 8, are capable of receiving up to three stacked cons of selected denominations. In the embodiment herein shown, receptacles 120, 122, 124 and 126 are sized to receive three quarters, making possible a maximum vend amount of $1.50.

Selectively configured individual disks 114, 116 and 118 may be chosen to vary this vend amount by providing coin receptacles varying in coin size, and in depth from one to three coins. As an example, receptacles 120 and 122 may be formed as follows: disk 114 may have a first, quarter-sized slot and *no* second slot; disks 116 and 118 may have first, quarter-sized slots and, second, dime-sized slots. This creates a vent amount of 95 cents (three quarters and two dimes). In this fashion, a single vending mechanism, provided with preselected coin-receiving wheels, makes possible the simple adjustment of vend amounts in a positive, simple and mechanical fashion wihout the need for an electric or electronic coin-metering apparatus.

Where, for example, the vended item is to be sold at a price of $1.00, a two-disk wheel is configured to accept two quarters in each coin receptacle. Should a lower-priced item be substituted, the wheel may be changed to, e.g., a "75 cent" wheel (one receptacle accepting two quarters with the adjacent receptacle accepting one quarter), or a "70 cent" wheel (one receptacle accepting two quarters with the adjacent receptacle accepting two dimes). Other wheel configurations may include more than three disks, if desired.

The foregoing description of the invention is, by way of example only, the scope of the invention being defined by the appended claims.

The embodiments of the invention in which an exclusive property or privilege is claimed are as follows:

1. Coin-operated dispensing mechanism comprising:

a disc-like coin-receiving wheel having at least a first perimetrical coin-receiving receptacle having a thickness substantially equal to a plural multiple of the thickness of a coin of predetermined denomination;

said first receptacle dimensioned for receiving a number of coins of said predetermined denomination in face-to-face relationship, said number equal to said plural multiple;

a second perimetrical coin-receiving receptacle the same as and diametrically spaced from said first receptacle;

a third perimetrical coin-receiving receptacle in close circumferential proximity to said first receptacle and dimensioned to receive a coin of preselected denomination;

a fourth perimetrical coin-receiving receptacle in close circumferential proximity to said second coin-receiving receptacle and diametrically spaced and the same as the third-coin-receiving receptacle;

said wheel having a first lobed portion circumferentially between said first and third coin-receiving receptacles, a second lobed portion circumferentially between said second and fourth coin-receiving receptacles, a third lobed portion adjacent to said fourth coin-receiving receptacle, a first convex arcuate porrtion adjacent to said first coin-receiving receptacle, a first substantially planar portion between said first arcuate portion and said third lobed portion, a first shallow concave portion between said first planar portion and said third lobed portion, a fourth lobed portion adjacent to said third coin-receiving receptacle, a second convex arcuate portion adjacent to said second coin-receiving receptacle, a second substantially planar portion between said second arcuate portion and said fourth lobed portion and a second shallow concave portion between said second planar portion and said fourth lobed portion, said first and second lobed portions being alike and diametrically opposite, said third and fourth lobed portions being alike and diametrically opposite, said first and second arcuate portions being alike and diametrically opposite, said first and second planar portions being alike and diametrically opposite and substantially parallel and said first and second concave portions being alike and diametrically opposite.

2. The mechanism according to claim 1 wherein said first receptacle differs in size from said third receptacle, and said second receptacle differs identically in size from said fourth receptacle to make possible the insertion of a coin or coins of a first size in said first and third receptacles and a coin or coins of a different, second size in said second and fourth receptacles.

3. The mechanism according to claim 1 wherein said wheel has a non-circular central hole therethrough and said mechanism further comprises a front cover plate having a coin-receiving slot, a rear plate, first and second spacer strips between said cover plate and said rear plate, said spacer strips having spaced apart generally arcuate inner edges defining arcs of a common circle and the thickness of said spacer strips being slightly greater than that of said wheel, said wheel being between said cover and rear plates and said spacer strips, said cover and rear plates having aligned central apertures therethrough, an operating knob protruding from said cover plate and having a non-circular shaft extending through said central aperture of said cover plate, said non-circular central hole through said wheel and said central aperture of said rear plate, such that rotation of said knob rotates said wheel, an acutator member secured to the end of said shaft remote from said knob and having a finger for engaging and moving a dispensing member to perform a dispensing function, and a plurality of pawls for preventing a dispensing operation, except when coins are properly placed in said wheel receptacles, while allowing dispensing operation when coins are properly in said receptacles, said pawls including a coin pawl and an independently functioning auxiliary coin pawl which prevents dispensing rotation of said wheel if less than the proper number of coins is in a receptacle.

4. The mechanism according to claim 3 wherein said coin pawl and said auxiliary pawl function to prevent dispensing rotation of said wheel in the absence of proper coins by engaging one of said lobed portions of said wheel.

* * * * *